US006504455B2

(12) United States Patent
Toda et al.

(10) Patent No.: US 6,504,455 B2
(45) Date of Patent: Jan. 7, 2003

(54) DIELECTRIC FILTER, DIELECTRIC DUPLEXER, COMMUNICATION SYSTEM, AND METHOD OF PRODUCING DIELECTRIC FILTER

(75) Inventors: Jun Toda, Ishikawa-ken (JP); Motoharu Hiroshima, Ishikawa-ken (JP); Hideyuki Kato, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/764,045

(22) Filed: Jan. 17, 2001

(65) Prior Publication Data

US 2001/0043131 A1 Nov. 22, 2001

(30) Foreign Application Priority Data

Jan. 17, 2000 (JP) ..... 2000-007450

(51) Int. Cl.[7] ..... H01P 1/213; H01P 1/201
(52) U.S. Cl. ..... 333/202; 333/206; 333/222
(58) Field of Search ..... 333/202, 206, 333/222, 207, 223

(56) References Cited

U.S. PATENT DOCUMENTS 5,162,760 A 11/1992 Phillips et al. ..... 333/206
5,815,056 A * 9/1998 Tada et al. ..... 250/337

FOREIGN PATENT DOCUMENTS

| | | |
|---|---|---|
| EP | 0743696 A1 | 11/1996 |
| EP | 0817302 A2 | 1/1998 |
| EP | 0865094 A2 | 9/1998 |
| EP | 0951089 A2 | 10/1999 |
| JP | 7-15206 | 1/1995 |
| JP | 7135405 | 5/1995 |
| JP | 8316703 | 11/1996 |

OTHER PUBLICATIONS

French Search Report dated Mar. 25, 2002.
German Office Action dated Jul. 22, 2002.

* cited by examiner

*Primary Examiner*—Robert Pascal
*Assistant Examiner*—Kimberly E Glenn
(74) *Attorney, Agent, or Firm*—Ostrolenk, Faber, Gerb & Soffen, LLP

(57) ABSTRACT

Inner-conductor holes whose internal surfaces are coated with inner conductors are provided in a dielectric block. Input/output electrodes are provided on the outside of the dielectric block, coupled to the inner conductors by electrostatic capacitance. Gap portions are provided between the input/output electrodes and an outer conductor. The input/output electrodes may be formed to extend from a bottom surface (mounting surface) and onto a side surface of an external surface of the dielectric block. Filter characteristics are determined depending on a width or a depth of the gap portion on the side surface of the dielectric block.

8 Claims, 7 Drawing Sheets

DIELECTRIC FILTER, DIELECTRIC DUPLEXER, COMMUNICATION SYSTEM, AND METHOD OF PRODUCING DIELECTRIC FILTER

BACKGROUND OF THE INVENTION

1. Field of the Invention

The present invention relates to a dielectric filter in which a conductive film is formed on an internal surface and an external surface of a dielectric block, to a dielectric duplexer, to a communication system using the dielectric filter and the dielectric duplexer, and to a method of producing the dielectric filter.

2. Description of the Related Art

Conventional dielectric filters are disclosed in Japanese Unexamined Patent Application Publication No. 08-316703, Japanese Unexamined Patent Application Publication No. 07-135405, and U.S. Pat. No. 5,162,760.

In Japanese Unexamined Patent Application Publication No. 08-316703, there is disclosed a dielectric filter in which input/output electrodes are formed on a mounting surface and a side surface of a dielectric block, and a gap between an input/output electrode on the mounting surface and an outer conductor is different from a gap between an input/output electrode on the side surface and an outer conductor, thereby decreasing the level of spurious responses.

In Japanese Unexamined Patent Application Publication No. 07-135405, there is disclosed a dielectric filter in which an electrostatic capacitance generated between input/output electrodes and an outer conductor is controlled by changing the width of a gap between the outer conductor and the input/output electrodes, thereby adjusting the phase characteristics.

In U.S. Pat. No. 5,162,760, there is disclosed a dielectric filter in which input/output electrodes are formed with a mesa structure in which a dielectric block is partially cut, on a bottom surface (mounting surface) of the dielectric block, in order to provide isolation between the two input/output electrodes.

However, in Japanese Unexamined Patent Application Publication No. 08-316703 and Japanese Unexamined Patent Application Publication No. 07-135405, the arrangements for controlling the electrostatic capacitance generated between the input/output electrodes and the outer conductor are not disclosed. Therefore, if the dielectric filter is smaller and the distance between the input/output electrodes is shorter, sufficient isolation between the input/output electrodes cannot be assured.

Also, the dielectric filter disclosed in U.S. Pat. No. 5,162,760 has problems in that if the filter is small and the space, in the alignment direction, between a plurality of inner-conductive holes is small, the gap between the two input/output electrodes becomes narrow when the input/output electrodes have a mesa structure and a sufficient isolation cannot be assured between the input and the output, thereby causing unwanted coupling.

SUMMARY OF THE INVENTION

In order to address these problems, the present invention provides a dielectric filter and a dielectric duplexer in which the degree of freedom of design is improved and stable characteristics can be obtained. The invention also provides a communication system using the dielectric filter and/or the dielectric duplexer.

According to one aspect of the present invention, there is provided a dielectric filter which has a substantially rectangular-parallelepiped shape including: a dielectric block; an inner-conductor hole in the dielectric block; an inner conductor which coats the inner conductor hole in the dielectric block; an input/output electrode which is coupled to the inner conductor by electrostatic capacitance on the dielectric block; and an outer conductor which is coupled to the inner conductor by electrostatic capacitance on the dielectric block, wherein a gap portion is provided to extend from a bottom surface over a side surface of the dielectric block by cutting a part of the outer conductor and the body of the dielectric block, thereby forming the input/output electrode to be isolated from the outer conductor and allowing filter characteristics to be determined depending on a width or a depth of the gap portion on the side surface.

In the dielectric filter, the electrostatic capacitance between the input/output electrode and the outer conductor can be decreased without reducing an area of the input/output electrode, by providing the gap portion between the input/output electrode and the outer conductor, thereby improving the degree of freedom of design. The electrostatic capacitance generated between the input/output electrode and the outer conductor is decreased, thereby decreasing an effect on the filter characteristics due to the dimensional precision of the input/output electrode. Accordingly, stable filter characteristics can be obtained.

According to another aspect of the dielectric filter, the input/output electrode is provided only on the bottom of the dielectric block and only the gap portion is formed on the side surface of the dielectric block, thereby determining the filter characteristics depending on the width or depth of the gap portion on the side surface. That is, depending on the width or the depth of the gap portion on the side surface of the dielectric block, the electrostatic capacitance generated between the inner conductor and the outer conductor is changed and impedance characteristics of resonators are changed. Thereby, the filter characteristics are determined. The gap portion between the input/output electrode and the outer conductor on the side surface of the dielectric block is enlarged and a changing range of the amount of coupling between the resonator and an external load is increased.

According to other aspects of the dielectric filter, the depth of the gap portion is partly changed, thereby determining the filter characteristics. That is, the degree of change in the electrostatic capacitance generated between the input/output electrode and the outer conductor differs from the degree of change in the electrostatic capacitance generated between the input/output electrode and the inner conductor depending on the changed depth of the gap portion. Accordingly, the depth of the gap portion can be partly changed, thereby determining the filter characteristics.

In other aspects of the dielectric filter, a part of the input/output electrode on the side surface is cut and the width of the gap portion is partly changed, thereby determining the filter characteristics. In this case, the degree of change in the electrostatic capacitance generated between the input/output electrode and the outer conductor differs from the degree of change in the electrostatic capacitance generated between the input/output electrode and the inner conductor depending on a position at which the input/output electrode is partly cut. Accordingly, the position is changed, thereby determining the filter characteristics.

Also, it is possible to almost independently determine the electrostatic capacitance generated between the input/output electrode and the outer conductor and the electrostatic capacitance generated between the input/output electrode and the inner conductor. Thus, a changing range of the filter characteristics can further be increased.

According to another aspect of the present invention, there is provided a dielectric duplexer including a plurality of dielectric filters having the above-described structure wherein three or more of the input/output electrodes are provided on the dielectric block. That is, a plurality of dielectric filters are provided on a single dielectric block and the structure of the input/output electrode has any one of the structures of the above-described dielectric filters, thereby determining the filter characteristics of the dielectric filters.

Further, according to another aspect of the present invention, there is provided a communication system using the dielectric filter and/or the dielectric duplexer. Thus, it is possible to obtain a communication system having excellent high-frequency circuit characteristics by use of a dielectric filter and/or a dielectric duplexer which properly correspond to required characteristics.

Furthermore, according to another aspect of the present invention, there is provided a method of producing a dielectric filter having a dielectric block, an inner-conductor hole in the dielectric block, an inner conductor which coats the inner conductor hole in the dielectric block, an input/output electrode which is coupled to the inner conductor by electrostatic capacitance on the dielectric block, and an outer conductor which is coupled to the inner conductor by electrostatic capacitance on the dielectric block, which includes the steps of: forming the input/output electrode to be isolated from the outer conductor by providing a gap portion extending from a bottom surface and onto a side surface of the dielectric block by cutting a part of the outer conductor and the body of the dielectric block; and determining filter characteristics depending on a width or a depth of the gap portion on the side surface.

Also, the method of producing the dielectric filter includes the steps of: providing the input/output electrode only on the bottom of the dielectric block; forming only the gap portion on the side surface of the dielectric block; and determining the filter characteristics depending on the width or the depth of the gap portion on the side surface.

Further, the method of producing the dielectric filter includes the step of partly changing the depth of the gap portion, thereby determining the filter characteristics.

Furthermore, the method of producing the dielectric filter includes the steps of: cutting a part of the input/output electrode on the side surface; and partly changing the width of the gap portion, thereby determining the filter characteristics.

Moreover, the method of producing the dielectric filter includes the steps of: forming a conductive film over the entire external surface of the dielectric block; and thereafter, providing the gap portion, thereby isolating the outer conductor and the input/output electrode.

Other features and advantages of the present invention will become apparent from the following description of embodiments of the invention which refers to the accompanying drawings, in which like references denote like elements and parts.

DESCRIPTION OF EMBODIMENTS OF THE INVENTION

Hereinbelow, the structure of a dielectric filter according to a first embodiment will be illustrated with reference to FIGS. 1 to 3B.

Figure 1:
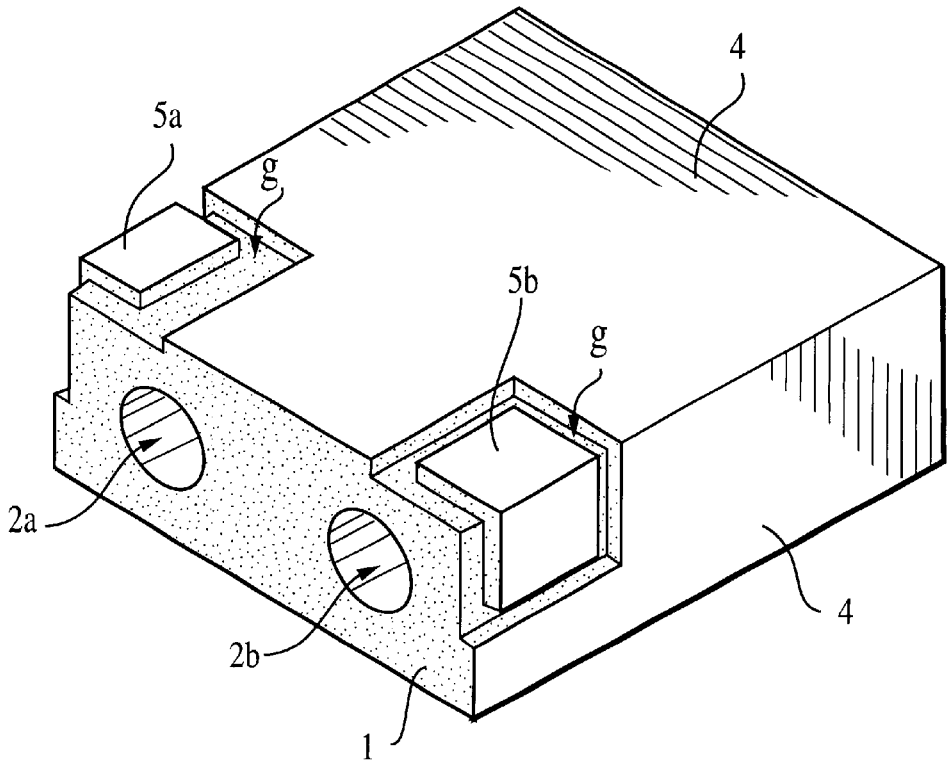
FIG. 1 is a perspective view of a dielectric filter according to a first embodiment.
Figure 2:
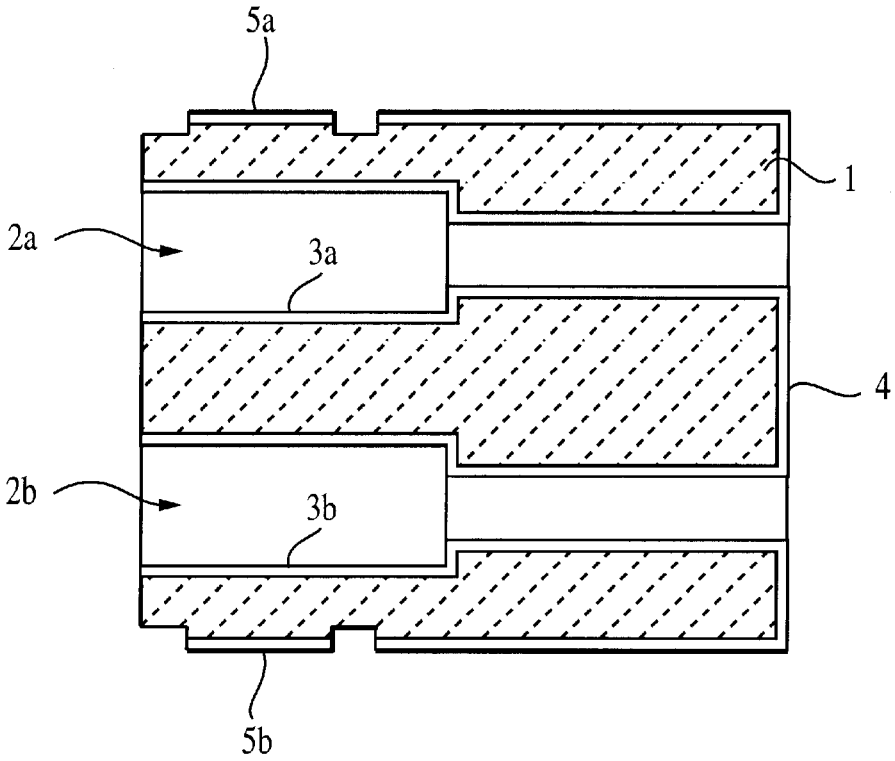
FIG. 2 is a central cross-sectional view of the dielectric filter of the first embodiment.
Figure 3A:
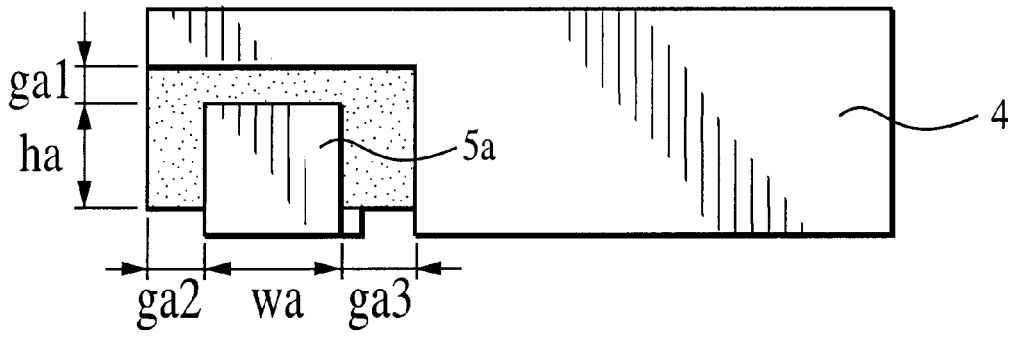
FIGS. 3A and 3B are a side view and a bottom view of the dielectric filter of the first embodiment, respectively.
Figure 3B:
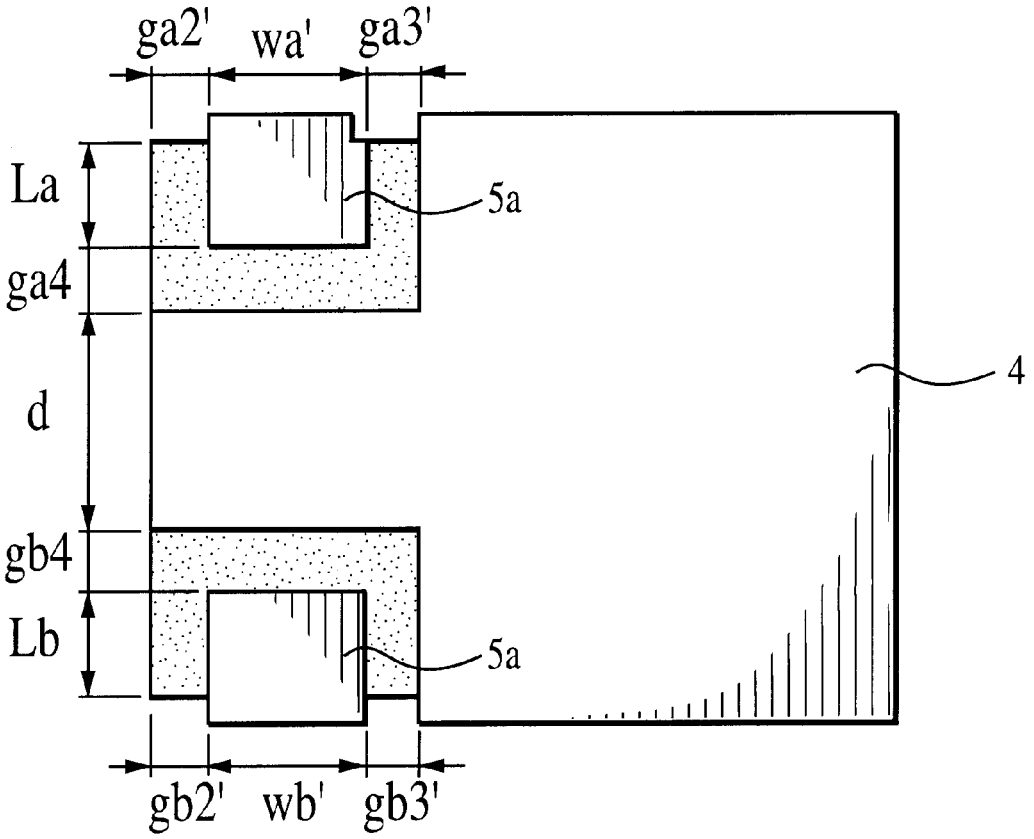

FIG. 1 is a perspective view of the dielectric filter according to the first embodiment, FIG. 2 is a central cross-sectional view of the dielectric filter, and FIGS. 3A and 3B are a side view and a top view of the dielectric filter, respectively. As shown in the figures, inner-conductor holes 2*a* and 2*b* whose internal surfaces are coated with inner conductors 3*a* and 3*b*, respectively, are provided in a dielectric block 1 which is substantially a rectangular parallelepiped, and input/output electrodes 5*a* and 5*b* and an outer conductor 4 are formed on external surfaces of the dielectric block 1. The inner-conductor holes 2*a* and 2*b* penetrate from a first end surface of the dielectric block 1 to a second end surface facing thereto, as shown in FIG. 2. The first end surface of the dielectric block 1 is an open surface forming an open-circuited end of each inner conductor, and the outer conductor 4 is formed on the second end surface, forming a short-circuited end of each inner conductor. The inner-conductor holes 2*a* and 2*b* have a stepped structure in which the internal diameter at the open end is large and the internal diameter at the short-circuited end is small. Internal surfaces of the inner-conductor holes 2*a* and 2*b* are coated with the inner conductors 3*a* and 3*b*, and one end of each of the inner-conductor holes is connected to the outer conductor 4 at the short-circuited end surface.

Two resonators comprise the inner conductors 3*a* and 3*b*, the dielectric block 1, and the outer conductor 4, and the resonators are electromagnetically coupled.

The input/output electrodes 5*a* and 5*b* are provided on the external surface of the dielectric block 1 to extend from the top surface onto respective side-surfaces, as shown in FIG. 1. Cuts are made in the outer conductor 4 and the dielectric body of the dielectric block 1, to form the input/output electrodes 5*a* and 5*b* in the form of islands which are isolated from the external conductor 4. Incidentally, the top surface in FIG. 1 becomes a mounting surface for mounting the filter on a circuit board in communication equipment, etc.

The input/output electrodes 5*a* and 5*b* are electrostatically coupled near the open ends of the resonators comprising the inner conductors 3*a* and 3*b*, the dielectric block 1, and the outer conductor 4.

With the above-described structure, the dielectric filter functions as a filter which comprises the two resonators coupled to the outside by electrostatic capacitance, and the filter has band-pass characteristics.

FIGS. 3A and 3B are diagrams showing dimensions of the gap portions between the input/output electrodes and the outer conductor and dimensions of the input/output electrodes. An electrostatic capacitance generated between the input/output electrode 5*a* and the inner conductor 3*a* in the dielectric block 1 shown in FIG. 2 is determined depending on the opposing area of the input/output electrode 5*a* and the inner conductor 3*a*, namely, dimensions wa, ha, wa', and La. The amount of coupling between the input/output electrode 5*a* and the inner conductor 3*a* is determined by the amount of electrostatic capacitance generated therebetween and on the position of the input/output electrode 5*a* facing the inner conductor 3*a*, namely, the dimensions of gap portions ga2 and ga2'. The amount of coupling between the input/output electrode 5*a* and the outer conductor 4 is determined by the dimensions of gap portions gal, ga3, ga3', and ga4, and the depths to which the gap portions are cut (referred to as the cut depth). The impedance characteristics of the resonator due to the inner conductor 3*a* are changed depending on the widths and depths of the gap portions between the input/output electrode 5*a* and the outer conductor 4.

Among those dimensions of the gap portions, the dimensions ga2, wa, and ga3 do not necessarily match the dimensions ga2', wa', and ga3', respectively. (Compare FIGS. 1 and 2 with FIGS. 3A and 3B, for example.) That is, the dimensions of the input/output electrode 5*a* on the bottom surface of the dielectric block 1 and the width and the depth of the gap portion between the input/output electrode 5*a* and the outer conductor 4 are predetermined and the dimensions and the position of the input/output electrode 5*a* on the side surface of the dielectric block 1 are variable, thereby determining the amount of coupling between the input/output electrode 5*a* and the inner conductor 3*a*. The impedance characteristics of the resonator due to the inner conductor 3*a* are determined depending on the widths and the depths of the gap portions between the input/output electrode 5*a* and the outer conductor 4 on the side surface of the dielectric block 1.

The above description also applies to the other input/output electrode 5*b*. The amount of coupling between the input/output electrode 5*b* and the inner conductor 3*b* changes by changing the dimensions and the position of the input/output electrode 5*b*. The impedance characteristics of the resonator due to the inner conductor 3*b* are determined depending on the widths and the depths of the gap portions between the input/output electrode 5*b* and the outer conductor 4 on the side surface of the dielectric block 1.

Incidentally, by forming the input/output electrodes 5*a* and 5*b* to extend from the bottom surface and onto the side surfaces of the dielectric block 1, it is possible to reduce the areas of the portions of the input/output electrodes 5*a* and 5*b* on the bottom surface of the dielectric block 1. Thus, it is possible to correspondingly increase a width d of the portion of the outer conductor 4 between the two input/output electrodes 5*a* and 5*b*, and thereby ensure sufficient isolation between the two input/output electrodes 5*a* and 5*b* if the dielectric filter becomes small.

Since the patterns of the input/output electrodes 5*a* and 5*b* on the bottom surface (mounting surface) of the dielectric block 1 can be fixed, it is possible to standardize the patterns of a conductive land and a ground electrode on a circuit board to which the filter is to be mounted.

Further, according to the first embodiment, a plurality of kinds of filters having different characteristics can be manufactured by using a common dielectric block. Thereby, the dielectric block can be used with multiple filter designs.

Next, the structure of a dielectric filter according to a second embodiment will be described with reference to FIGS. 4, 5A, and 5B.

Figure 4:
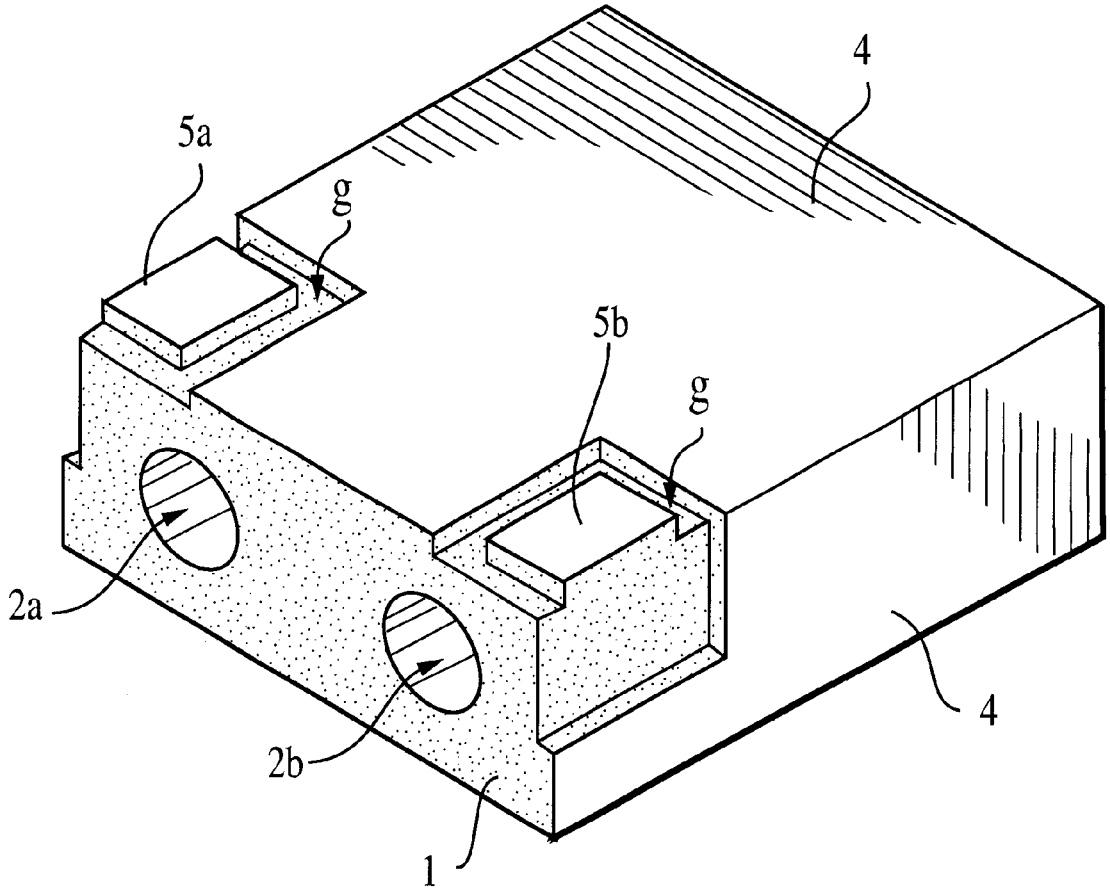
FIG. 4 is a perspective view of a dielectric filter according to a second embodiment.
Figure 5A:
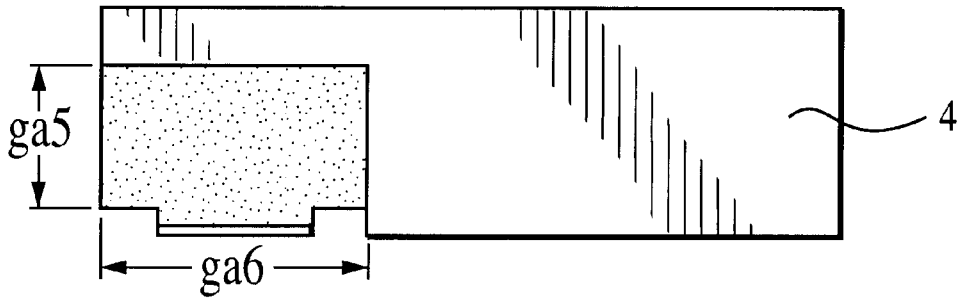
FIGS. 5A and 5B are a side view and a bottom view of the dielectric filter of the second embodiment, respectively.
Figure 5B:
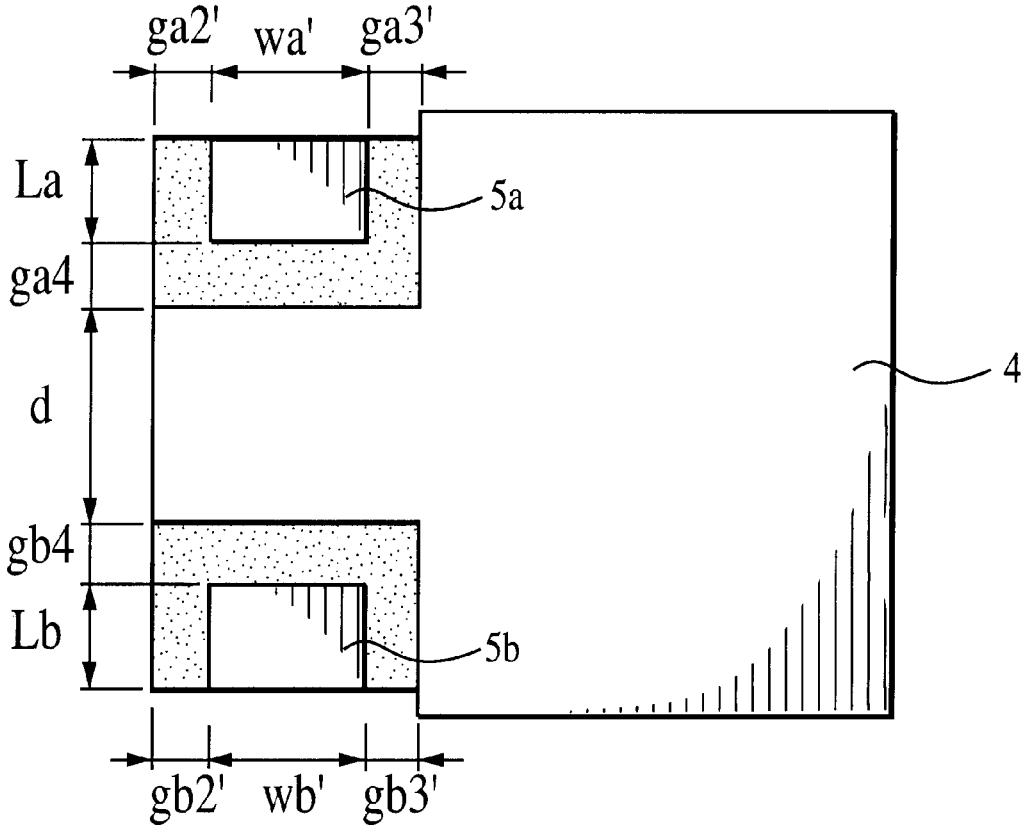

FIG. 4 is a perspective view of the appearance of the dielectric filter according to the second embodiment, and FIGS. 5A and 5B are a side view and a top view of the dielectric filter, respectively. The dielectric filter in the second embodiment is different from that shown in FIG. 1 in that the input/output electrodes 5*a* and 5*b* are provided only on a top surface (mounting surface) of a dielectric block 1, and only gap portions are provided on side surfaces thereof. The structure in other portions is similar to that in the first embodiment.

In the structure, the dielectric filter 1 functions as a filter which comprises two resonators coupled to the outside by electrostatic capacitance and has band-pass characteristics.

FIGS. 5A and 5B are diagrams showing the dimensions of gap portions between input/output electrodes 5*a* and 5*b* and an outer conductor 4 and dimensions of the input/output electrodes 5*a* and 5*b*, in which FIG. 5A shows a side view of the dielectric filter and FIG. 5B shows a bottom view of the dielectric filter. An electrostatic capacitance generated between the input/output electrode 5*a* and an inner conductor (not shown) on the internal surface of an inner-conductor hole 2*a* in the dielectric block 1 shown in FIG. 4 is determined depending on the opposing area of the input/output electrode 5*a* and the inner conductor, namely, by dimensions wa' and La. The amount of coupling between the input/output electrode 5*a* and the inner conductor is determined by the amount of electrostatic capacitance generated therebetween and the position of the input/output electrode 5*a* opposing the inner conductor, namely, by the dimension of a gap portion ga2'. The amount of electrostatic capacitance generated between the input/output electrode 5*a* and the outer conductor 4 is determined depending on gap portions ga3', ga4, ga5, and ga6, and the cut depths of the gap portions. The impedance characteristics of the resonator are changed depending on widths and depths of the gap portions.

Among those dimensions of the gap portions, a dimension (ga2'+wa'+ga3') does not necessarily match the dimension of the gap portion ga6. That is, the dimensions of the input/output electrode 5*a* on the bottom surface of the dielectric block 1 and the widths and the depths of the gap portions between the input/output electrode 5*a* and the outer conductor 4 are predetermined and the widths and the depths of the gap portions on the side surface of the dielectric block 1 are variable, thereby determining the impedance characteristics of the resonator.

The above description is also applicable to the other input/output electrode 5*b*. The amount of coupling between the input/output electrode 5*b* and the inner conductor is determined by changing the dimensions and the position of the input/output electrode 5*b*. The impedance characteristics of the resonator are determined by the widths and the depths of the gap portions on the side surface of the dielectric block 1.

As mentioned above, the input/output electrodes 5*a* and 5*b* are provided only on the bottom surface (mounting surface) of the dielectric block 1 and only the gap portions between the input/output electrodes 5*a* and 5*b* and the outer conductor 4 are formed on the side surface of the dielectric block 1, thereby enabling a wide range of widths ga5 and ga6 of the gap portions ga5 and ga6 of the side surface of the dielectric block 1 to be set. Accordingly, the amount of external coupling can be set over a wide range and the degree of freedom of design can be improved. Accordingly, a predetermined amount of external coupling can be obtained if the input/output electrodes 5*a* and 5*b* are formed only on the bottom surface of the dielectric block 1. It is possible to ensure sufficient isolation between the input/output electrode 5*a* and 5*b* by increasing the dimension d corresponding thereto.

Figure 6A:
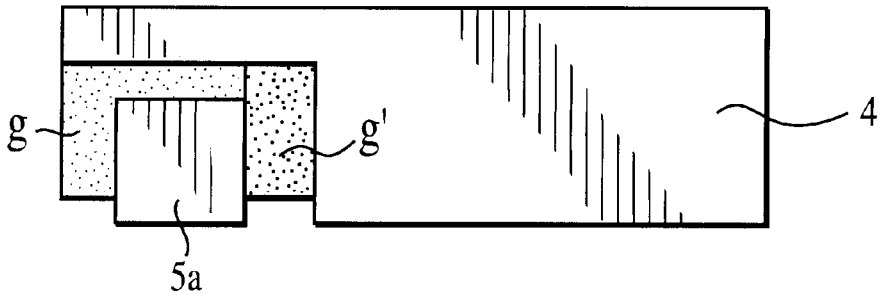
FIGS. 6A to 6C are side views showing the structures of three dielectric filters according to a third embodiment.
Figure 6B:
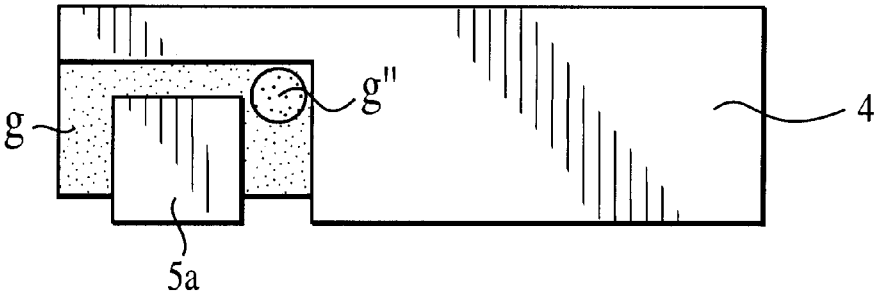
Figure 6C:
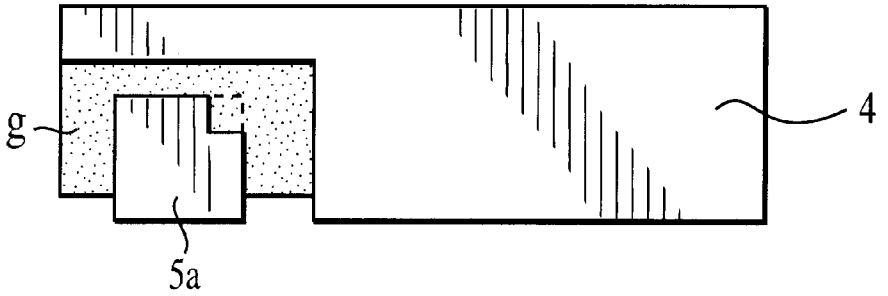

Next, a description is given of some examples of a dielectric filter according to a third embodiment with reference to FIGS. 6A–6C.

FIGS. 6A to 6C are side views of the dielectric filter. Because the structures of the other surfaces of the dielectric block are similar to those shown in FIG. 1 to FIGS. 3A and 3B, the description thereof is omitted.

In an example shown in FIG. 6A, a cut depth of a gap portion g between an input/output electrode 5*a* and an outer conductor 4 is different from that in a gap portion g'. In an example shown in FIG. 6B, a gap portion g" is deeper than the gap portion g. The degree of change in the electrostatic capacitance generated between the input/output electrode 5*a* and an inner conductor differs from the degree of change in the electrostatic capacitance generated between the input/output electrode 5*a* and the outer conductor 4 depending on the change in the cut depth of the gap portion. Accordingly, in the ge structures, the cut depth of the gap portion is partly changed, thereby determining desired filter characteristics.

In an example shown in FIG. 6C, the overall shape of the gap portion g between the input/output 5*a* and the outer conductor 4 is rectangular and a part of the input/output electrode 5*a* is cut as shown by a broken line, thereby partly changing the width of the gap portion g. The degree of change in the electrostatic capacitance generated between the input/output electrode 5*a* and the inner conductor differs from the degree of change in the electrostatic capacitance generated between the input/output electrode 5*a* and the outer conductor 4 depending on the position of the partly cut position of the input/output electrode 5*a*. Accordingly, the partly-cut position can be changed so as to determine the desired filter characteristics.

Figure 7A:
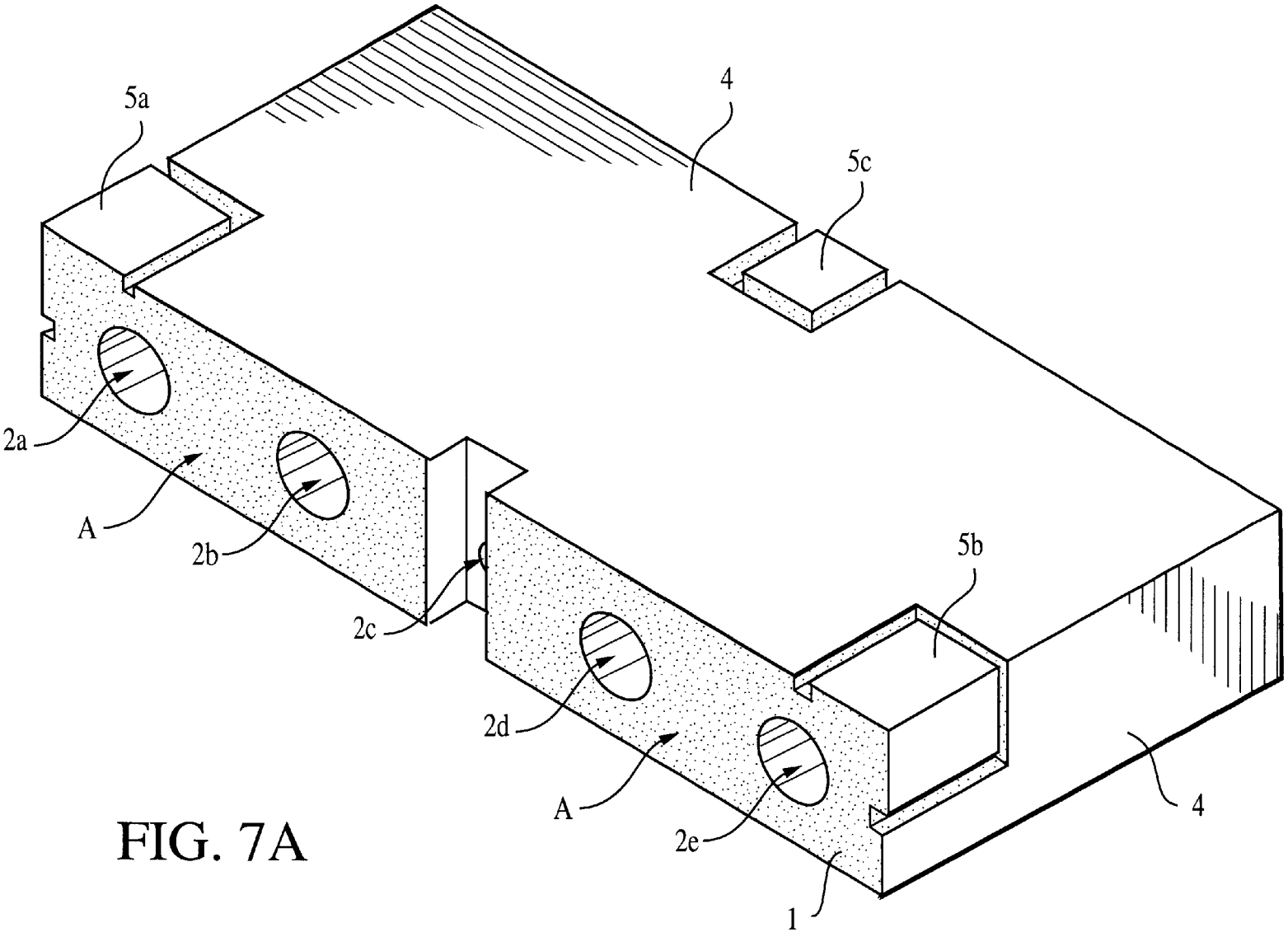
FIGS. 7A and 7B are diagrams showing the structure of a dielectric duplexer according to a fourth embodiment.
Figure 7B:
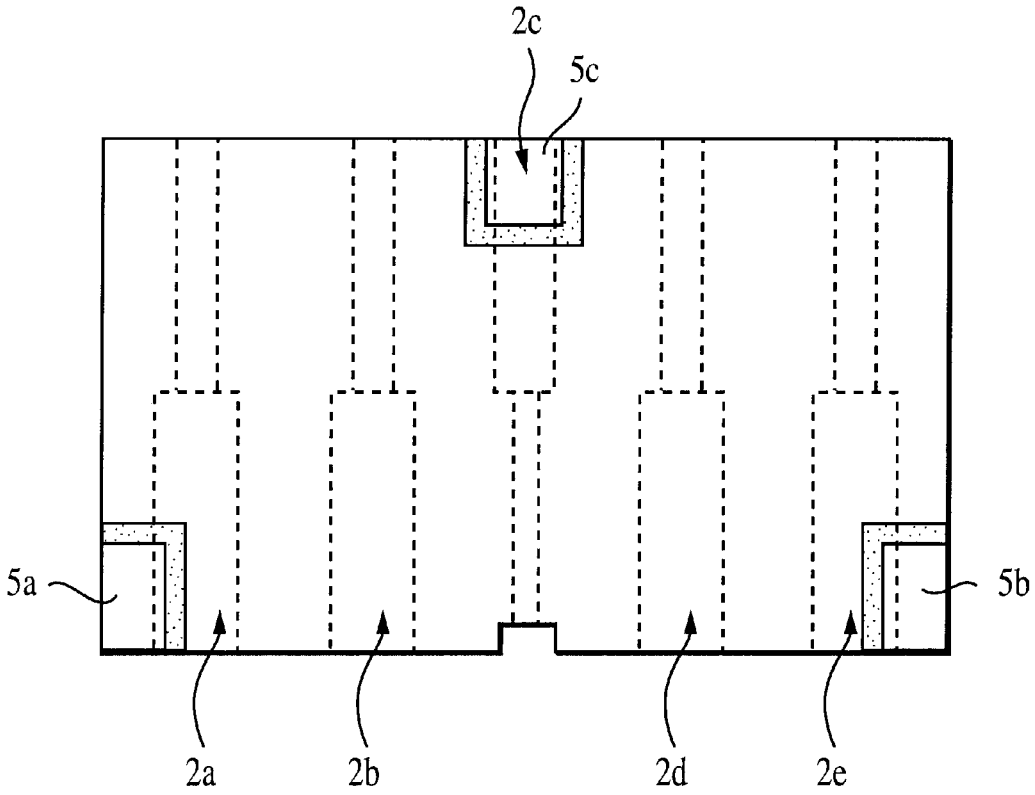

Next, a description is given of a dielectric duplexer according to a fourth embodiment with reference to FIGS. 7A and 7B.

FIG. 7A is a perspective view of the dielectric duplexer, and FIG. 7B is a top view of the dielectric duplexer. Referring to FIGS. 7A and 7B, reference numeral 1 denotes a dielectric block which is substantially a rectangular parallelepiped and has inner-conductor holes 2*a*, 2*b*, 2*d*, and 2*e* which extend from a first end surface A of the dielectric block 1 to a second end surface facing thereto. Inner conductors are formed on internal surfaces of the inner-conductor holes 2*a*, 2*b*, 2*d*, and 2*e*. An outer conductor 4 is provided on the external surfaces (five sides) excluding the first surface A. The first surface A is an open surface and the surface of the dielectric 20 block 1 towards rear-right in FIG. 7A is a short-circuited surface.

An inner-conductor hole 2*c* having therein an inner conductor is formed at the center of the dielectric block 1. A surface at the front-left in FIG. 7A is a short-circuited end and a surface at the rear-right in FIG. 7A is an open end. An input/output electrode 5*c* is formed to extend from the open end of the inner 25 conductor hole 2*c* over a top surface of the dielectric block 1 in FIG. 7A. Further, input/output electrodes 5*a* and 5*b* are formed on the external surface of the dielectric block 1 to be isolated from the outer conductor 4. These input/output electrodes 5*a* and 5*b* are formed by cutting the surface of the dielectric block 1. Incidentally, the top surface in FIGS. 7A and 7B is a surface for mounting on a circuit board (mounting surface).

Two resonators having the inner-conductor holes 2*a* and 2*b* are coupled and function as a filter having band-pass characteristics similarly to that of the first embodiment shown in FIG. 1. Similarly, two resonators having the inner-conductor holes 2*d* and 2*e* coupled and function as a filter having band-pass characteristics.

The inner conductors on the internal surfaces of the inner-conductor holes 2*b* and 2*c* are inter-digitally coupled. The inner conductors on the internal surfaces of the inner-conductor holes 2*c* and 2*d* are also inter-digitally coupled. Thereby, a dielectric duplexer is formed, in which the input/output electrode 5*a* is a transmission-signal input port, the input/output electrode 5*b* is a reception-signal output port, and the input/output electrode 5*c* is an input/output port for possible connection to an antenna.

Figure 8:
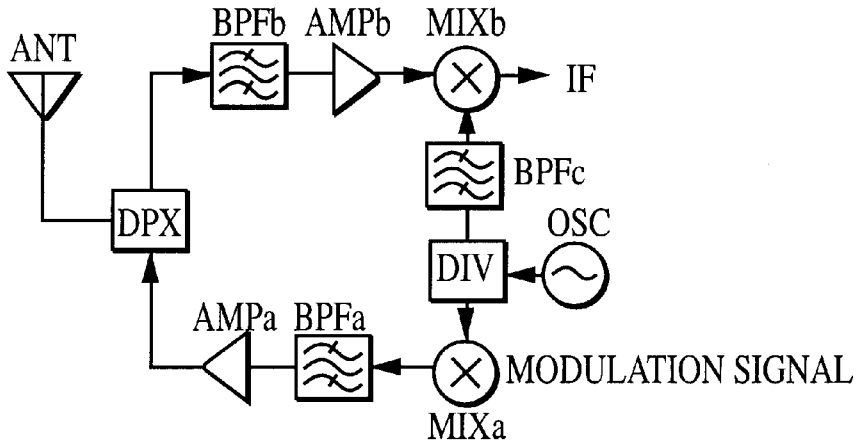
FIG. 8 a block diagram showing the configuration of a communication system according to a fifth embodiment.

Next, a description is given of the configuration of a communication system according to a fifth embodiment with reference to FIG. 8. Referring to FIG. 8, reference symbol ANT denotes a receiving/transmitting antenna; DPX denotes a duplexer; BPFa, BPFb, and BPFc denote band-pass filters; AMPa and AMPb denote amplifying circuits; MIXa and MIXb denote mixers; OSC denotes an oscillator; and DIV denotes a divider (synthesizer). The mixer MIXa modulates a frequency signal outputted from the divider DIV by a modulating signal. Via the band-pass filter BPFa, only a band of a transmission frequency passes, and the amplifying circuit AMPa amplifies a signal of the passing band and the amplified signal is transmitted by the receiving/transmitting antenna ANT via the duplexer DPX. Only a reception frequency band in signals outputted by the duplexer DPX passes through the band-pass filter BPFb, and the amplifying circuit AMPb amplifies the passing signal. The mixer MIXb mixes a frequency signal outputted by the band-pass filter BPFc and a reception signal and outputs an intermediate frequency signal IF.

The duplexer DPX shown in FIG. 8 may use a dielectric duplexer having the structure shown in FIGS. 7A and 7B. The band-pass filters BPFa, BPFb, and BPFc may use the dielectric filter having the structure shown in FIG. 1 or 4. Thereby, the communication equipment is compact.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter having a substantially rectangular-parallelepiped shape comprising:

a dielectric block;

an inner-conductor hole in said dielectric block;

an inner conductor which coats said inner-conductor hole in said dielectric block;

an input/output electrode on said dielectric block which is coupled to said inner conductor by electrostatic capacitance; and an outer conductor on said dielectric block, which is coupled to said inner conductor by electrostatic capacitance, wherein a gap portion is provided by a cut portion of said outer conductor and a corresponding cut portion of said dielectric block, extending from a bottom surface and onto a side surface of said dielectric block, thereby forming the input/output electrode to be isolated from said outer conductor and allowing filter characteristics to be determined depending on a width or a depth of said gap portion on said side surface;

wherein said input/output electrode is provided only on the bottom of the dielectric block and only said gap portion is formed on the side surface of said dielectric block, thereby determining the filter characteristics depending on the width or the depth of said gap portion on said side surface.

2. A dielectric filter having a substantially rectangular-parallelepiped shape comprising:

a dielectric block;

an inner-conductor hole in said dielectric block;

an inner conductor which coats said inner-conductor hole in said dielectric block;

an input/output electrode on said dielectric block which is coupled to said inner conductor by electrostatic capacitance; and an outer conductor on said dielectric block, which is coupled to said inner conductor by electrostatic capacitance, wherein a gap portion is provided by a cut portion of said outer conductor and a corresponding cut portion of said dielectric block, extending from a bottom surface and onto a side surface of said dielectric block, thereby forming the input/output electrode to be isolated from said outer conductor and allowing filter characteristics to be determined depending on a width or a depth of said gap portion on said side surface;

wherein said gap portion has at least two parts with different depths, thereby determining said filter characteristics.

3. A dielectric filter having a substantially rectangular-parallelepiped shape comprising:

a dielectric block;

an inner-conductor hole in said dielectric block;

an inner conductor which coats said inner-conductor hole in said dielectric block;

an input/output electrode on said dielectric block which is coupled to said inner conductor by electrostatic capacitance; and an outer conductor on said dielectric block, which is coupled to said inner conductor by electrostatic capacitance, wherein a gap portion is provided by a cut portion of said outer conductor and a corresponding cut portion of said dielectric block, extending from a bottom surface and onto a side surface of said dielectric block, thereby forming the input/output electrode to be isolated from said outer conductor and allowing filter characteristics to be determined depending on a width or a depth of said gap portion on said side surface;

wherein said input/output electrode on said side surface has at least two parts with different widths, whereby said gap portion has at least two parts with different widths, thereby determining said filter characteristics.

4. A dielectric duplexer comprising:

two dielectric filters according to any one of claims 1 to 3, said filters both being coupled with a common input/output electrode, each said filter further having a respective additional input/output electrode.

5. A communication system comprising:

a dielectric duplexer according to claim 4; and at least one of a transmitting circuit and a receiving circuit being connected to at least one of said additional input/output electrodes.

6. A method of producing a dielectric filter having a dielectric block, an inner-conductor hole in said dielectric block, an inner conductor which coats said inner conductor hole in said dielectric block, an input/output electrode on said dielectric block which is coupled to said inner conductor by electrostatic capacitance, and an outer conductor on said dielectric block, which is coupled to said inner conductor by electrostatic capacitance, said method comprising the steps of:

forming the input/output electrode to be isolated from said outer conductor by providing a gap portion extending from a bottom surface and onto a side surface of said dielectric block by cutting a part of said outer conductor and a corresponding part of said dielectric block;

adjusting a width or a depth of said gap portion on said side surface so as to obtain desired filter characteristics;

providing said input/output electrode only on the bottom of the dielectric block;

forming only said gap portion on the side surface of said dielectric block; and obtaining said desired filter characteristics by adjusting the width or the depth of the gap portion on said side surface.

7. A method of producing a dielectric filter having a dielectric block, an inner-conductor hole in said dielectric block, an inner conductor which coats said inner conductor hole in said dielectric block, an input/output electrode on said dielectric block which is coupled to said inner conductor by electrostatic capacitance, and an outer conductor on said dielectric block, which is coupled to said inner conductor by electrostatic capacitance, said method comprising the steps of:

forming the input/output electrode to be isolated from said outer conductor by providing a gap portion extending from a bottom surface and onto a side surface of said dielectric block by cutting a part of said outer conductor and a corresponding part of said dielectric block;

adjusting a width or a depth of said gap portion on said side surface so as to obtain desired filter characteristics; and changing the depth of only a part of said gap portion, thereby obtaining said desired filter characteristics.

8. A method of producing a dielectric filter having a dielectric block, an inner-conductor hole in said dielectric block, an inner conductor which coats said inner conductor hole in said dielectric block, an input/output electrode on said dielectric block which is coupled to said inner conductor by electrostatic capacitance, and an outer conductor on said dielectric block, which is coupled to said inner conductor by electrostatic capacitance, said method comprising the steps of:

forming the input/output electrode to be isolated from said outer conductor by providing a gap portion extending from a bottom surface and onto a side surface of said dielectric block by cutting a part of said outer conductor and a corresponding part of said dielectric block;

adjusting a width or a depth of said gap portion on said side surface so as to obtain desired filter characteristics; and cutting a part of the input/output electrode on said side surface, thereby changing the width of only a part of said gap portion, thereby obtaining said desired filter characteristics.

* * * * *